United States Patent [19]

Ito et al.

[11] Patent Number: 4,583,733

[45] Date of Patent: Apr. 22, 1986

[54] BASEBALL BAT SWING MEASURING DEVICE

[75] Inventors: Sho Ito; Tomoyuki Nakaguchi; Kumio Kasahara; Toshio Takei; Tsutomu Hashimoto; Shojiro Nakahara, all of Kanagawa, Japan

[73] Assignee: Mitsubishi Denki Kabushiki Kaisha, Tokyo, Japan

[21] Appl. No.: 764,523

[22] Filed: Aug. 12, 1985

Related U.S. Application Data

[63] Continuation of Ser. No. 509,503, Jun. 30, 1983, abandoned.

[30] Foreign Application Priority Data

Jun. 30, 1982 [JP] Japan ..... 57-113549

[51] Int. Cl.[4] ..... A63B 71/02

[52] U.S. Cl. ..... 273/26 R; 273/26 B; 434/247

[58] Field of Search ..... 273/26 R, 25, 26 A, 273/26 B, 32 H, 181 H, 181 E, 181 A, 181 G, 186 RA, 186 B, 186 C, 186 A; 350/169; 356/373, 375; 434/247

[56] References Cited

U.S. PATENT DOCUMENTS

| | | | |
|---|---|---|---|
| 3,117,451 | 1/1964 | Ray et al. | 273/26 R |
| 4,150,825 | 4/1979 | Wilson | 273/185 B |
| 4,306,722 | 12/1981 | Rusnak | 273/186 R |
| 4,367,009 | 1/1983 | Suzki | 350/169 |
| 4,461,477 | 7/1984 | Stewart | 273/26 R |

FOREIGN PATENT DOCUMENTS

| | | | |
|---|---|---|---|
| 1190564 | 5/1970 | United Kingdom | 350/169 |

*Primary Examiner*—Richard C. Pinkham
*Assistant Examiner*—MaryAnn Stoll Lastova
*Attorney, Agent, or Firm*—Sughrue, Mion, Zinn, Macpeak and Seas

[57] ABSTRACT

A batting practice trainer includes a laser oscillator placed in a sensor unit configured to resemble a home plate. Three beams are emitted from the sensor unit in a predetermined pattern, so that the height, speed, and angle of elevation of a swinging bat may be calculated from the passage of the bat across the beams. This is accomplished without interferring with the batters' swing or substantially modifying the bat.

15 Claims, 10 Drawing Figures

BASEBALL BAT SWING MEASURING DEVICE

This application is a continuation of application Ser. No. 509,503, filed June 30, 1983, now abandoned.

BACKGROUND OF THE INVENTION

This invention relates to a swing measuring device for measuring the inclination and height of the swing plane of a baseball bat and the speed of the bat.

Heretofore, there has not been available a swing measuring device of this type which could be used outdoors. Accordingly, in order to train baseball players, it was necessary to provide a particular area in a gymnasium under safety control. Thus, it was rather difficult to train baseball players with high efficiency.

SUMMARY OF THE INVENTION

In view of the foregoing, an object of this invention is to provide a swing measuring device which comprises a laser oscillator emitting a laser beam of high directivity provided in a sensor unit similar in configuration to a home plate, and light receiving elements and optical systems for receiving the laser beams reflected from a baseball bat, so that the angle of elevation of the bat and the spped of the bat may be measured in an open area without contacting either the baseball player or the baseball bat.

DETAILED DESCRIPTION OF THE PREFERRED EMBODIMENTS

Figure 1A:
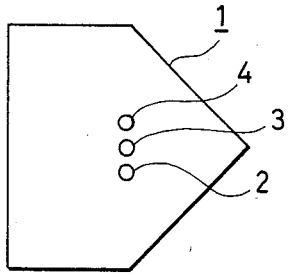
FIGS. 1(*a*) and (*b*) and 2 are diagrams describing the principles of the invention, and, especially.
Figure 1B:
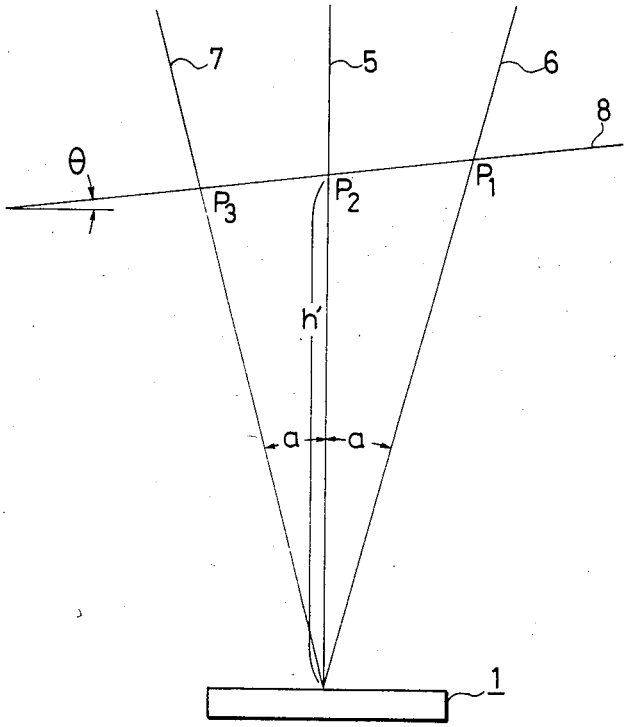
Figure 1C:
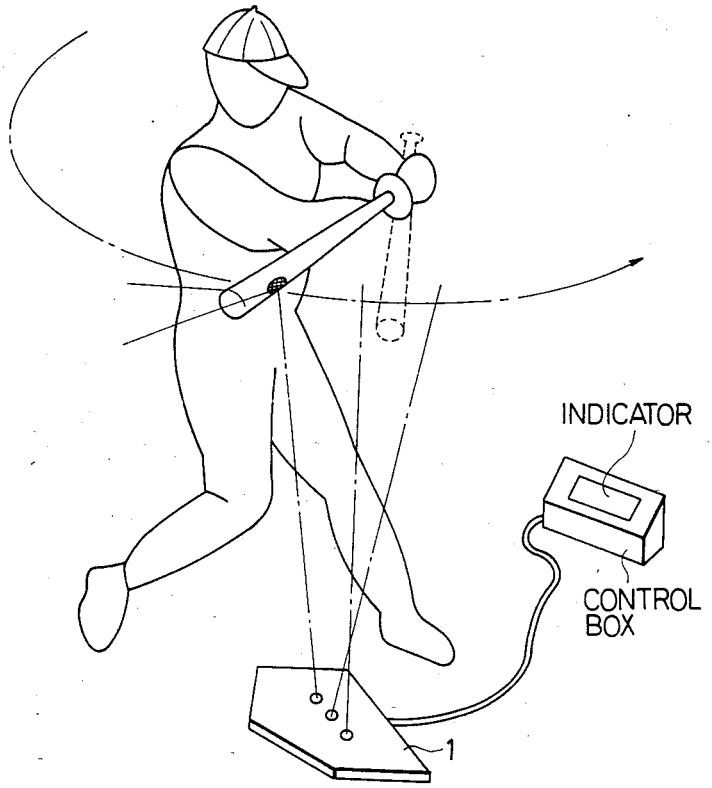

FIGS. 1*a* and 1*b* are diagrams describing the principles of the invention. In FIGS. 1, reference numeral 1 designates a sensor unit in the form of a home plate; 2, a first light transmitting and receiving hole for transmitting a first light beam perpendicular to the sensor unit and for receiving a light beam reflected from the baseball bat; 3, a second light transmitting and receiving hole for transmitting a second light beam, which forms an angle a with the first light beam and is inclined towards the catcher and for receiving a light beam reflected from the baseball bat; and 4, a third light transmitting and receiving hole for transmitting a third light beam inclined by an angle a towards the pitcher in the plane defined by the first and second light beams. Further in FIG. 1(*b*), reference numeral 5 designates the aforementioned first light beam, 6, the second light beam; 7, the third light beam; and 8, the line of intersection along which the swing plane of a baseball bat intersects the plane defined by the first, second and third light beams 5, 6 and 7.

If the first light beam 5 intersects the line of intersection 8 at a distance h' above the sensor unit 1, and the line of intersection 8 forms an angle $\theta$ with the sensor unit, then the coordinates of the intersections $P_1$, $P_2$ and $P_3$ of the three light beams 6, 5 and 7 and the line of intersections 8, and the lengths of segments $\overline{P_1P_2}$, $\overline{P_2P_3}$ and $\overline{P_1P_3}$ are as follows:

$$\text{Intersection } P_1 \left( \frac{-h'}{\tan\theta - a}, \frac{-a \cdot h'}{\tan\theta - a} \right)$$

$$\text{Intersection } P_2 \ (0, h')$$

$$\text{Intersection } P_3 \left( \frac{-h'}{\tan\theta + a}, \frac{a \cdot h'}{\tan\theta + a} \right)$$

$$\text{Segment } \overline{P_1P_2} = \frac{1}{\tan\theta - a} \sqrt{1 + \tan^2\theta \cdot h'} \tag{1}$$

$$\text{Segment } \overline{P_2P_3} = \frac{1}{\tan\theta + a} \sqrt{1 + \tan^2\theta \cdot h'} \tag{2}$$

$$\text{Segment } \overline{P_1P_3} = \frac{2ah'}{\tan^2\theta - a^2} \sqrt{1 + \tan^2\theta} \tag{3}$$

Therefore, the ratio (r) of the length of the segment $\overline{P_1P_2}$ to that of the segment $\overline{P_2P_3}$ is:

$$r = \frac{\overline{P_1P_2}}{\overline{P_2P_3}} = \frac{\tan\theta + a}{\tan\theta - a} \tag{4}$$

From Equation (4), $$\theta = \tan^{-1}\left( \frac{r+1}{r-1} a \right) \tag{5}$$

Therefore, if the difference (proportional to the length of segment $\overline{P_1P_2}$) between the time when the baseball bat crosses the second light beam 6 and the time when it crosses the first light beam 5, and the difference (proportional to the length of segment $\overline{P_2P_3}$) between when it crosses the first light beam 5 and the time when it crosses the third light beam 7 are measured, the ratio r can be obtained. Accordingly, the swing angle $\theta$ of the base ball bat can be determined from the slope a of the second and third light beams 6 and 7, which is selected in the manufacture of the sensor unit 1.

The speed v is obtained by dividing the segment length $\overline{P_1P_3}$ by the difference $\Delta t$ between the time when the baseball bat crosses the second light beam 6 and the time when it crosses the third light beam 7. Therefore, if the height h' of the baseball bat swing plane is known, the values $\theta$ and $\Delta t$ can be used to obtain the speed v as follows:

$$v = \frac{\overline{P_1P_3}}{\Delta t} \tag{6}$$

A method of measuring the height h' of the baseball bat swing plane will now be described.

Figure 2:
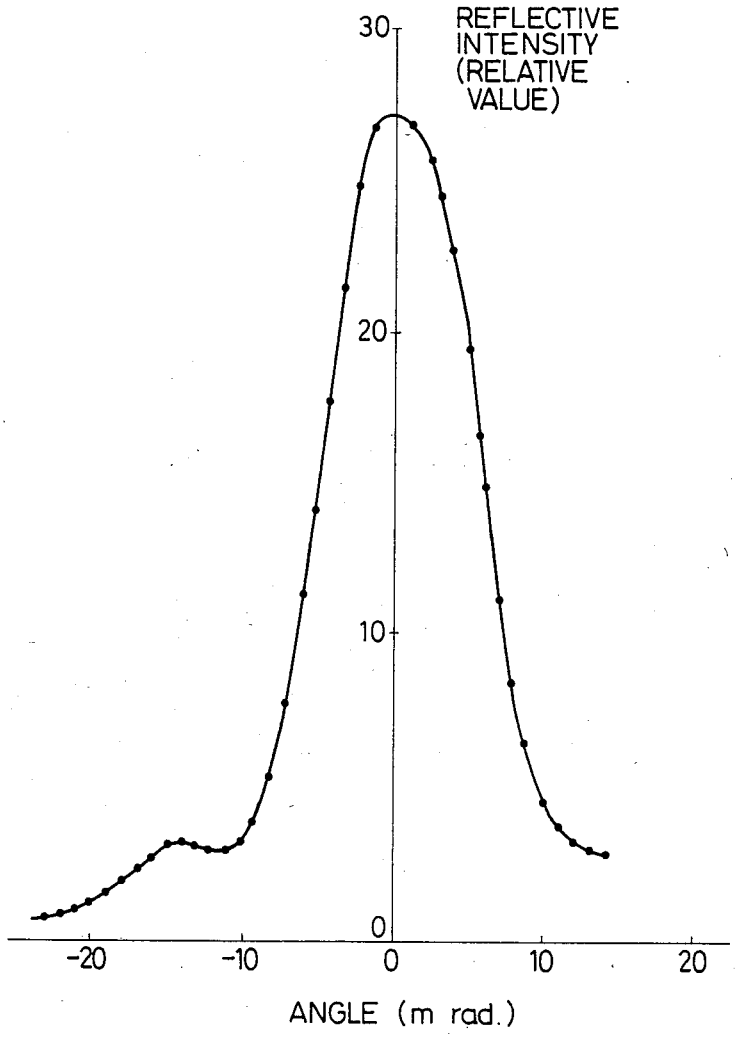
FIG. 2 shows the reflection pattern of a laser beam from a reflective sheet required for determining the height of the swing plane, FIG. 1(*c*) showing a state in which a measuring device according to the invention is used.
Figure 3:
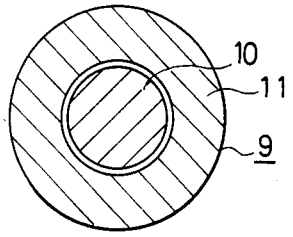
FIG. 3 is a explanatory diagram showing a light receiving unit having light receiving regions in the form of concentric circles.

A reflective sheet which is prepared by arranging a number of ball lenses made of transparent material of high refractive index in the form of a flat plate is bonded to a baseball bat with thermally active adhesive. When a laser beam is applied to the sheet on the baseball bat, the reflected light beam exhibits a reflective characteristic as shown in FIG. 2. One example of this reflective sheet is "Scotch" light marked high intensity grade reflective sheet 2870, which is manufactured by the 3M company. Therefore, if a light receiving unit 9 (FIG. 3) having two coaxial light receiving regions is used to perfrom the following calculation with respect to the output signals $S_1$ and $S_2$ of the light receiving regions, the calculated result H is determined with respect to h' between $h'_1$ and $h'_2$. The distance between the light receiving unit and the reflex sheet, can be determined, so that the height of the baseball bat swing plane may be determined.

$$H=(S_1-S_2)/(S_1+S_2) \quad (7)$$

Figure 4:
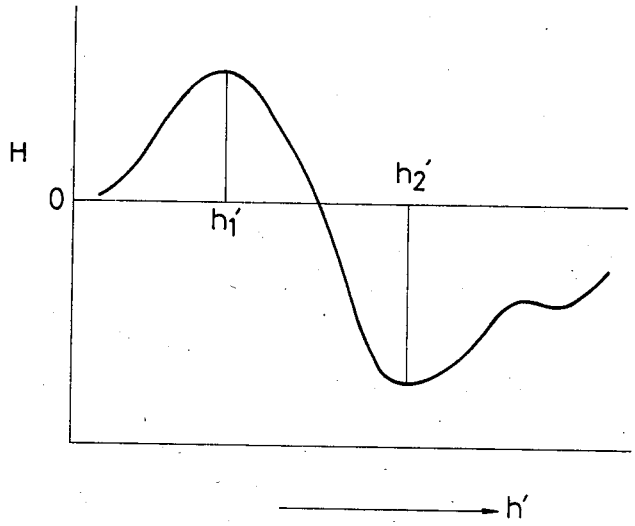
FIG. 4 is a graphic representation indicating the results of calculation in determining the swing height.

The result of the calculation of H depends on the value of h' as shown in FIG. 4. In the light receiving unit 9 in FIG. 3, the radius of the inner light receiving region 10 is one-half of the radius of the outside diameter of the outer light receiving region 11.

The operating principles of the swing measuring device according to the invention are as described above. One specific example of a swing measuring device operating according to the above-described principles will now be described.

Figure 5:
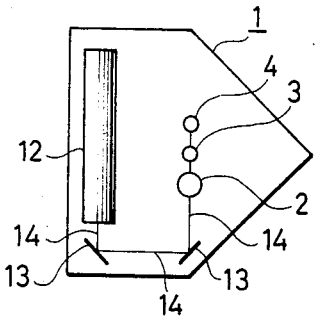
FIG. 5 is an explanatory diagram showing the components of a sensor of a swing measuring device according to this invention.
Figure 6:
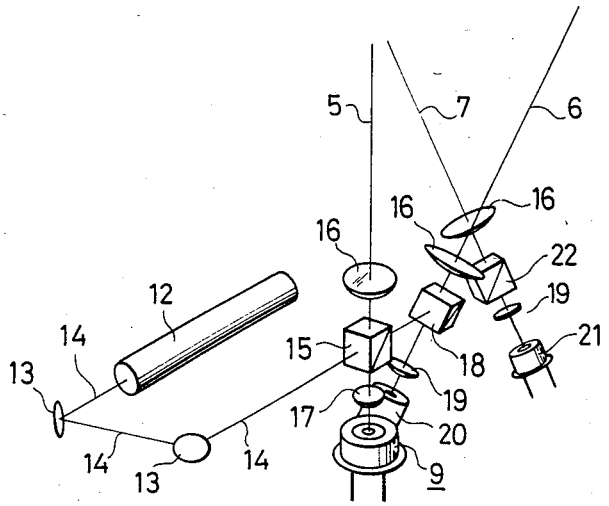
FIG. 6 is a perspective view showing the arrangement of the components in the sensor.

FIG. 5 is a top view showing the optical components, electrical components and a laser oscillator of the sensor unit 1. In FIG. 5, reference numeral 12 designates the laser oscillator; 13, total reflection mirrors; and 14, the output laser beam of the laser oscillator. FIG. 6 is a perspective view showing the components of the sensor unit 1. In the figure, reference numeral 15 designates a first beam split cube for reflecting a part of the incident laser beam 14 vertically upwardly of the sensor unit 1 and for transmitting the beam reflected from the reflective sheet on the baseball bat to the concentric-circle-shaped light receiving unit 9; 16, filters for transmitting only the laser beam from the laser oscillator; and 17, a first lens for condensing the laser beam reflected from the baseball bat. The light receiving unit 9 is positioned nearer to the first beam split cube 15 than the rear focal point of the first lens 17. Further in FIG. 6, reference numeral 18 designates a second beam split cube for reflecting a part of the incident laser beam obliquely upwardly to form the second laser beam and for transmitting the laser beam reflected from the reflective sheet; 19, second and third lenses for applying the reflected beams to second and third light receiving elements 20 and 21, respectively; and 22, a third beam split cube for forming the third laser beam.

Figure 7:
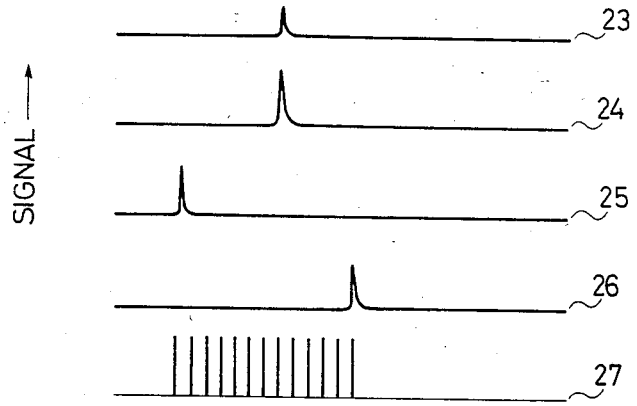
FIG. 7 is a diagram showing the light receiving signals of three light receiving elements, and a clock pulse train extracted by the light receiving signals.

The components are arranged as described above. Therefore, as the baseball bat crosses the three beams 6, 5 and 7, the reflected beams are transmitted to the respective light receiving units, so that light receiving signals are produced as shown in FIG. 7. In FIG. 7, reference numeral 23 designates the light receiving signal of the inner region 10 of the concentric-circle-shaped light receiving unit 9; 24, the light receiving signal of the outer region 11; 25, the light receiving signal of the second light receiving element 20; 26, the light receiving signal of the third light receiving element 21; and 27, a clock pulse train which is selected by the light receiving signals 25 and 26 of the second and third light receiving elements 20 and 21.

The sensor unit 1 is constructed as described above. Therefore, the three parameters respecting the baseball bat swing plane, namely, the height, speed and inclination can be determined from expressions (5), (6) and (7) as described before. A specific method of processing the signals will not be described in detail herein; however, the calculation of expressions (5) through (7) is carried out using a digital computer in a known fashion as follows.

Figure 8:
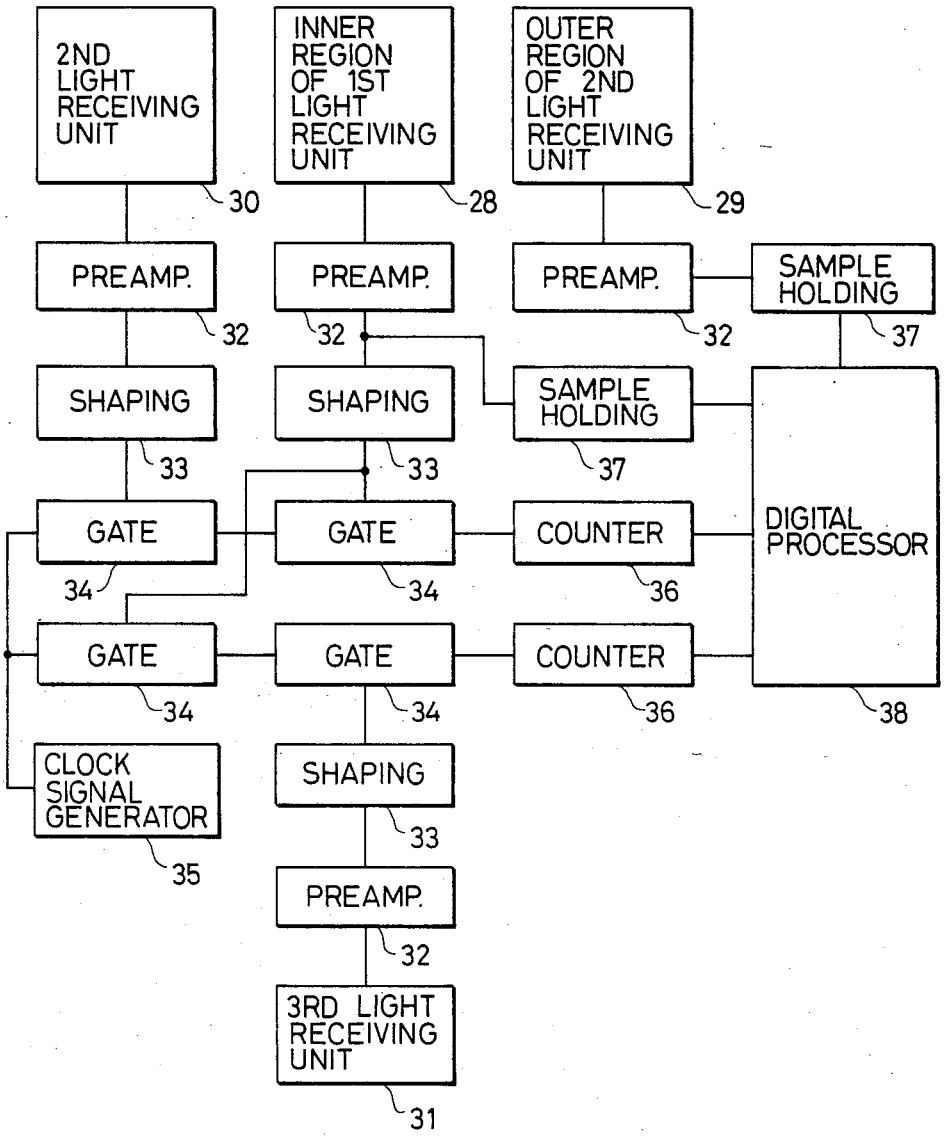
FIG. 8 is a block diagram showing the circuit for the sensor.

FIG. 8 is a block diagram showing the connection and construction of the signal processor for the swing measuring device with which the invention is concerned. In FIG. 8, reference numeral 28 denotes the inner region of the first light receiving unit; 29, the outer region of the first light receiving region; 30 and 31, the second and third light receiving units; 32, a preamplifier, 33, waveform shaping circuit; 34, a gate circuit, 35, a clock signal generator; 36, a counter for counting the number of the pulses of the pulse train of the clock signal determined by the gate circuit 34; 37, a sample hold circuit for holding the maximum value of a reflection signal obtained out of the inner and outer regions of the first light receiving unit; and 38, a digital processor for calculating the value of r on the basis of the outputs of the two counter circuits 36 and the two sample holding circuits 37 in accordance with the above-described expression (4), a swing angle $\theta$ by using the given data a and the calculated value of r, a swing height h' from the relationship between H and h' shown in FIG. 4 by using the calculated value of H in accordance with the above described expression (7) and a speed v in accordance with the expressions (3) and (6).

What is claimed is:

1. A baseball bat swing measuring device, comprising:

a base sensor unit having first, second and third holes formed at a predetermined interval in a direction perpendicular to a swing direction of a baseball bat;

beam emitting means disposed in said base sensor unit for emitting a first beam vertically upwardly of said base sensor unit through said first hole of said base sensor unit, emitting a second beam upwardly rearwardly through said second hole of said base sensor unit so as to be inclined at a predetermined angle with respect to said first beam, and emitting a third beam upwardly forwardly through said third hole of said base sensor unit to be inclined at substantially the same angle as that of said second beam;

first beam receiving means disposed in said base sensor unit for receiving through said first hole of said base sensor unit the first beam reflected from said baseball bat when said baseball bat passes across the first beam and for in turn outputting a signal in compliance with the reflection pattern of said first beam, said first beam receiving means including first and second concentrical beam receiving regions; and second and third beam receiving means disposed in said base sensor unit for receiving through said second and third holes of said base sensor unit the second and third beams reflected from said baseball bat when said baseball bat passes across the second and third beams and for in turn outputting signals therefor, respectively;

wherein in accordance with the output signal of said first receiving means, a swing height of said baseball bat from said base sensor unit is measured on the basis of the reflection pattern caused when the baseball bat passes across the first beam, and in accordance with the output signals of the first, second and third beam receiving means, an angle of the swing surface and a swing speed of said baseball bat are measured by differences between timings when the baseball bat passes across the first, second and third beams.

2. A device as claimed in claim 1, wherein said base sensor unit is shaped as a home-plate and said baseball bat has a reflective material thereon.

3. A device as claimed in claim 1, said optical means comprising a set of aligned beam splitters for forming said three laser beams from the output of said laser oscillator.

4. A device as claimed in claim 3, and further including photodetector means arranged below said beam splitters in a manner so as to receive reflected laser light.

5. A device as claimed in claim 4, wherein one of said photodetectors comprises a pair of concentric light receiving elements for receiving said reflection pattern, a ratio of the light received by said respective elements being indicative of the height of said baseball bat.

6. A swing measuring device, comprising:

a sensor unit having first, second and third holes, beam emitting means located in said sensor unit for emitting through said first hole a first beam upwardly with respect to said sensor unit, through said second hole a second beam upwardly and rearwardly with respect to said first beam at a predetermined angle, and through said third hole a third beam upwardly and forwardly with respect to said first beam at a predetermined angle, first receiving means located in said sensor unit for receiving the reflected beam generated when a baseball bat transverses said first beam and for generating an output signal in response to a pattern of reflection of said first beam, and second and third receiving means located in said sensor unit for receiving the reflected beams generated when the baseball bat transverses said second and third beams, respectively and for generating output signals in response to patterns of reflection of said second and third beams, respectively, wherein a height of a swing plane of a baseball bat from a level of said sensor unit is measured in accordance with the output signal of said first receiving means, and an inclination of the swing plane and a speed of the baseball bat are measured in accordance with the output signals of said first through third receiving means.

7. A device as claimed in claim 6, wherein said first beam is oriented in a perpendicular direction to said sensor unit.

8. A device as claimed in claim 6, wherein said predetermined angles of said second and third beams are substantially the same as each other.

9. A device as claimed in claim 6, wherein said first receiving means includes two concentric light receiving regions.

10. A device as claimed in claim 6, wherein said first through third holes of said sensor unit are spaced apart from each other at a predetermined interval and are arranged on a line substantially perpendicular to a swing direction of the baseball bat.

11. A device as claimed in claim 6, said beam emitting means comprising a laser oscillator and optical means for splitting the output laser beam of said laser oscillator into said first, second and third beams.

12. A device as claimed in claim 6, wherein said sensor unit is in the form of a home plate.

13. A swing measuring device, comprising:

a sensor unit having first, second and third holes spaced apart from each another at a predetermined interval on a line substantially perpendicular to a swing direction of a baseball bat, beam emitting means located in said sensor unit for emitting through said first hole a first beam upwardly with respect to said sensor unit, through said second hole a second beam upwardly and rearwardly with respect to said first beam at a predetermined angle, and through said third hole a third beam upwardly and forwardly with respect to said first beam at substantially the same angle, first receiving means located in said sensor unit for receiving the reflected beam generated when the baseball bat transverses said first beam and for generating an output signal in response to a pattern of reflection of said first beam, said first receiving means including two concentric light receiving regions, and second and third receiving means located in said sensor unit for receiving the reflected beams generated when the baseball bat transverses said second and third beams, respectively and for generating output signals in response to patterns of reflection of said second and third beams, respectively, wherein a height of a swing plate of a baseball bat from a level of said sensor unit is measured in accordance with the output signal of said first receiving means, and an inclination of the swing plane and a speed of the baseball bat are measured in accordance with the output signals of said first through third receiving means.

14. A device as claimed in claim 13, wherein said beam emitting means comprises a laser oscillator and optical means for splitting the output laser beam of said laser beam of said laser oscillator into said first, second and third beams.

15. A device as claimed in claim 13, wherein said sensor unit is in the form of the home plate.

* * * * *